United States Patent [19]

Raghavan et al.

[11] Patent Number: 4,597,737

[45] Date of Patent: Jul. 1, 1986

[54] METHOD AND APPARATUS FOR DRYING OR HEAT TREATING GRANULAR MATERIAL

[75] Inventors: Vijaya G. S. Raghavan; Kulbir Pannu, both of Ste. Anne de Bellevue, Canada

[73] Assignee: McGill University, Quebec, Canada

[21] Appl. No.: 641,610

[22] Filed: Aug. 17, 1984

[51] Int. Cl.[4] ..... F27B 15/00; F27B 7/14

[52] U.S. Cl. ..... 432/197; 432/118; 432/215

[58] Field of Search ..... 432/28, 112, 118, 197, 432/215; 165/DIG. 27

[56] References Cited

U.S. PATENT DOCUMENTS

| | | | |
|---|---|---|---|
| 2,872,386 | 2/1959 | Aspegren | 432/215 |
| 4,094,633 | 6/1978 | Peterson et al. | 432/197 |
| 4,474,553 | 10/1984 | Takahashi | 432/197 |

FOREIGN PATENT DOCUMENTS

| | | | |
|---|---|---|---|
| 1276282 | 6/1972 | United Kingdom | 432/118 |

*Primary Examiner*—John J. Camby

*Attorney, Agent, or Firm*—Oblon, Fisher, Spivak, McClelland & Maier

[57] ABSTRACT

A method and an apparatus for drying or heat treating granular material fed in a continuous flow. The apparatus comprises a heating container having an inlet end and an outlet end. A heating source is located entirely within the container. An auger conveyor is disposed in the container adjacent the inlet end to displace a particulate medium, capable of retaining heat, from the inlet end to a heat chamber within the container. A transporting mechanism is provided in the heating chamber for showering the particulate medium in direct contact with a flame during a predetermined time so that the medium is quickly heated to an approximate desired temperature. A mixing and drying conveyor mixes and conveys the heated particulate medium with a humid granular material whereby to dry the material by heat transfer between the particulate medium and the granular material. A separator then separates the particulate medium from the granular material. The particulate medium is then recycled while still hot and the dried granular material is recovered.

13 Claims, 3 Drawing Figures

METHOD AND APPARATUS FOR DRYING OR HEAT TREATING GRANULAR MATERIAL

BACKGROUND OF INVENTION

1. Field of the Invention

The present invention relates to a method and an apparatus for drying humid granular material fed thereto in a continuous flow and particularly to an improved drying apparatus capable of heating a humid particulate medium very quickly with the device being so constructed as to achieve minimum heat loss and occupy the minimum amount of space.

2. Description of Prior Art

Various drying apparatus are known for drying granular material such as grain, oil seeds, etc. It is also known to heat a particulate medium and to mix this medium with grain to be dried whereby to extract the humidity trapped in the grain. The particulate medium which is then cooled is recycled into the system. Such a device is disclosed in Canadian Pat. No. 808,874 issued on Mar. 25, 1969. The present invention is an improvement of the general type of apparatus as described in that patent.

SUMMARY OF INVENTION

It is a feature of the present invention to provide a compact drying apparatus for drying humid granular material, such as grain or the like granular material, in a very short period of time.

Another feature of the present invention is to provide a drying apparatus for drying granular material and wherein the particulate medium is quickly heated to a desired temperature and mixed with the grain to extract moisture therein and the particulate medium is extracted and recycled while still hot.

Another feature is to provide a drying apparatus for drying granular material and wherein the heating source is provided internally of the apparatus and the construction of the apparatus is such that minimum heat loss is achieved.

Another feature is to provide an improved method of drying granular material and wherein the particulate medium is quickly heated in a container by showering the particulate medium across a flame which is located internally of the container.

Another feature of the present invention is to provide a drying apparatus for drying granular material and wherein the particulate medium after being heated is mixed with a granular material to be dried and recycled into the heating chamber prior to cooling off whereby the particulate medium is quickly reheated to a desired temperature in the minimum amount of time.

According to the above features, from a broad aspect, the present invention provides a drying apparatus for drying granular material fed thereto in a continuous flow. The apparatus comprises a heating container having an inlet end and an outlet end. Heating means is provided in the container. Conveying means is provided in the container adjacent the inlet end whereby to displace a particulate medium capable of retaining heat from the inlet end to a heating chamber within the container. Shower means is disposed in the heating chamber for displacing the particulate medium for direct contact with a flame during a predetermined time so that the medium is quickly heated to an approximate desired temperature. Mixing and drying conveyor means is provided for mixing and conveying the heated particulate medium with a humid granular material whereby to dry the material by heat transfer between the particulate medium and the granular material. Means is provided to separate the particulate medium from the granular material. Further means is provided to recycle the particulate medium while still hot. Further means is provided to recover the dried granular material.

According to a further broad aspect of the present invention there is provided a method of drying granular material. The method comprises the steps of conveying a particulate medium capable of retaining heat through a heating container. The medium is showered in direct contact with a flame in a heat chamber within the container whereby to quickly heat the medium to an approximate desired temperature over a predetermined period of time. The heated particulate medium is then mixed and conveyed with a humid granular material whereby to dry the material by heat transfer between the particulate medium and the granular material. The dried material is then separated from the heated particulate medium and the medium is recycled while still hot to the inlet end of the container.

BRIEF DESCRIPTION OF DRAWINGS

A preferred embodiment will now be described with reference to an example thereof as illustrated in the accompanying drawings in which.

DESCRIPTION OF PREFERRED EMBODIMENTS

Figure 1:
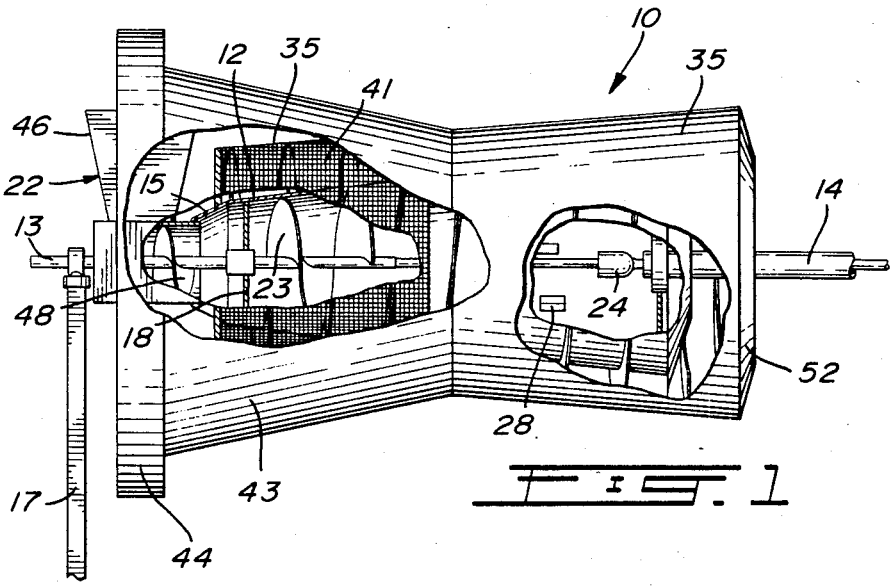
FIG. 1 is a fragmented side view of the drying apparatus of the present invention.

Referring now to the drawings, there is shown generally at 10 the drying apparatus of the present invention for drying a humid granular material 11 fed thereto in a continuous flow. The granular material may be grain, oil seed, rice, soy beans, ground nuts, or any granular material which is required to be heated. Also, the dryer 10 may be used both for on-farm or industrial applications and may be used alone for complete drying of a product or in combination with in-bin drying. In the latter case, a fraction of the exhaust air leaving the apparatus can be ducted whereby to use the hot outlet air to supplement heat to a grain storage bin, or the like, and thus make the system maximum efficient.

Figure 2:
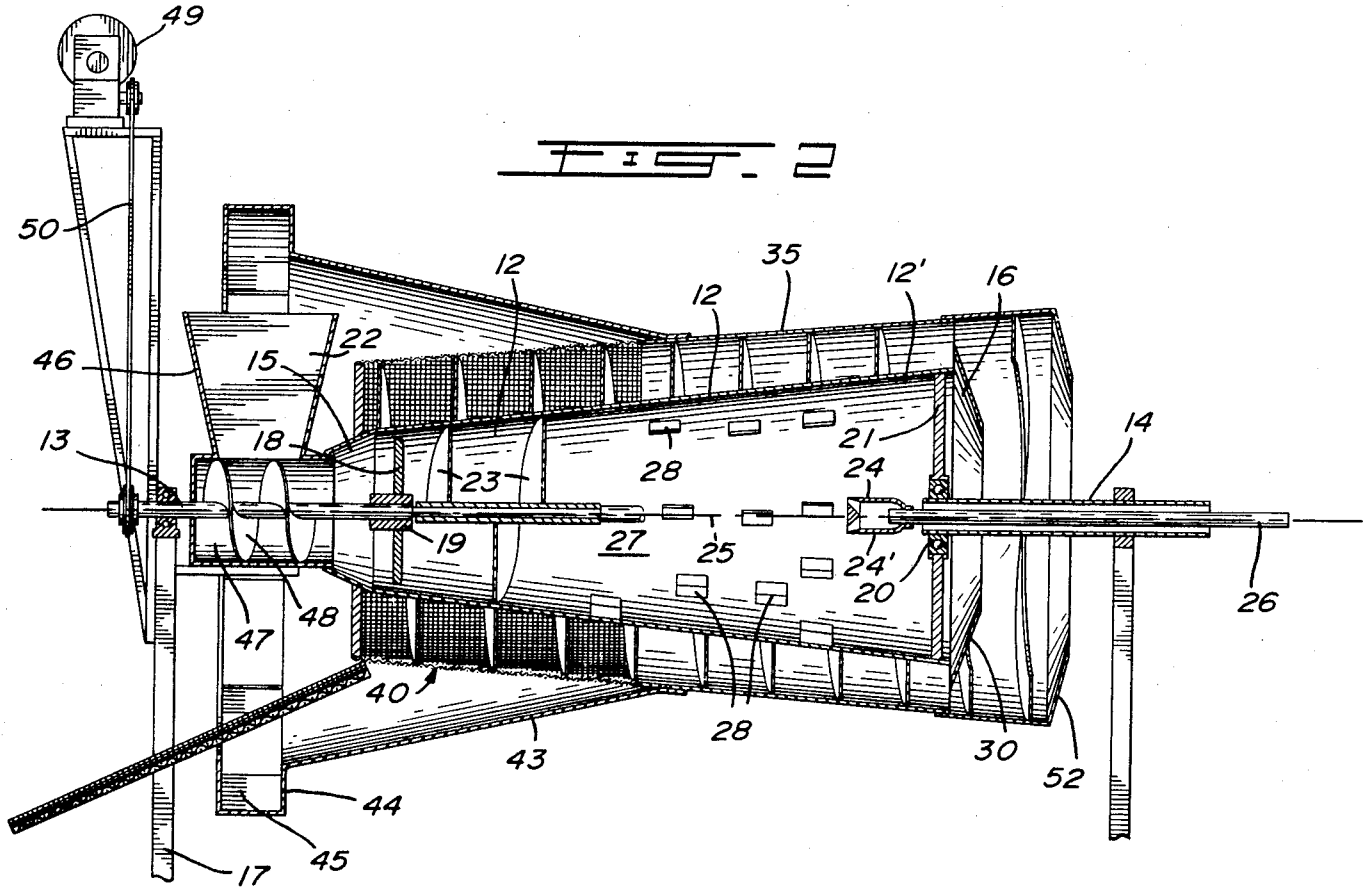
FIG. 2 is a side section view of the drying apparatus of the present invention.

The drying apparatus 10 comprises a heating container 12 in the form of a conical drum which is shaped as the frustum of a cone and which is axially supported between a drive shaft 13 and a stationary shaft 14 located respectively adjacent the inlet end 15 and the outlet end 16 of the container 12. As shown more clearly in FIG. 2, the apparatus 10 is supported by a main frame 17 which supports the drive shaft 13 and the stationary shaft 14. The drive shaft 13 is connected internally of the inlet end 15 to the container 12 by support ribs 18 radiating from a support bushing 19. The stationary shaft 14 is a hollow shaft and supports the outlet end 16 of the container 12 by a plurality of support ribs 21 bridging the container side wall 12' and a bearing bushing 20.

The heating container 12 has its smaller end disposed at the inlet end 15 and enlarges towards the outlet end 16. A feeding device 22 is located at the inlet end 15 whereby to feed a particulate medium 23' to the inlet end 15. A short conveyor auger 23 is supported internally of the heating container 12 adjacent the inlet end 15 and is secured to the drive shaft 13 through the bushing 19 whereby to feed the particulate medium, herein sand 23', to the heating container 12. The auger 23 is provided with a helix of increasing diameter whereby the peripheral edge of the helix is closely spaced to the side wall 12' whereby to obstruct the inlet end 15 to prevent excess heat loss from the heating container 12, and also to prevent the sand 23' from being blown out through the inlet end by a flame generated by a heating element 24 located adjacent the outlet end 16.

The heating element 24 is a propane burner and has a head 24' located adjacent the end of the hollow support shaft 14 and is situated on the central longitudinal axis 25 of the heating container 12. A gas feed line 26 extends through the hollow shaft 14 and into the burner head 24'. The burner 24 generates a flame which extends into a heating chamber 27 located adjacent the outlet end 16 of the heating container 12. Cold air is forced through the hollow shaft 14 by a suitable pump (not shown) to bring gaseous fuel to complete combustion and to cool the bearing bushing 20. Shower means, in the form of a plurality of scoop-like elements 28, are secured in staggered relationship to the side wall 12' and scoop up the sand 23' and release it in a shower-like form into the flame 29 generated by the propane burner 24. Thus, the sand is in direct contact with the flame and quickly heated to a desired temperature, herein to a temperature in the range of between 200° to 250° C. In some applications the sand can be heated up to 350° C. It is also pointed out that when the process is operating, the sand is reintroduced in the feeding device 22 at a temperature of about 100° C. Thus, within a short period of time, generally 15 to 20 seconds, the sand travels from the inlet end 15 to the outlet end 16 of the heating container 12 and reaches its desired temperature.

Figure 3:
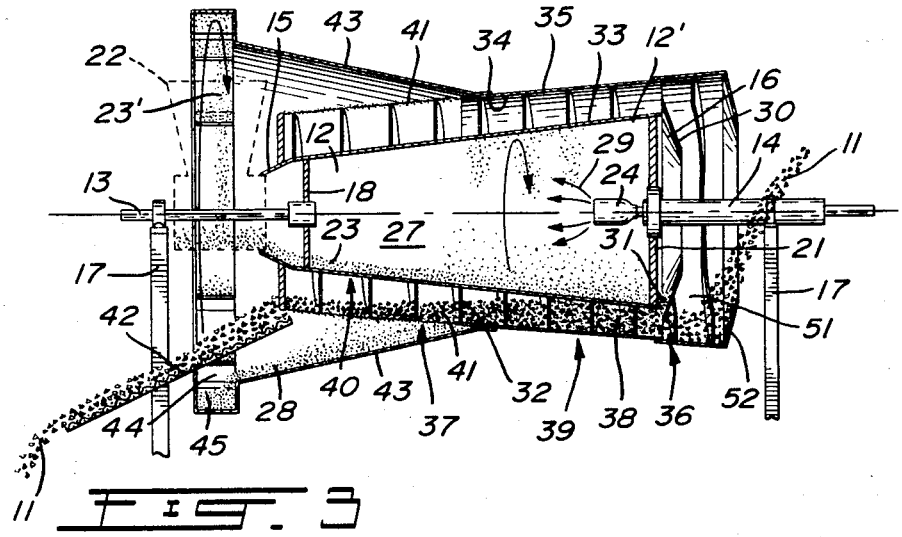
FIG. 3 is a side section view illustrating the operation of the drying apparatus of the present invention.

The outlet end 16 of the heating container 12 is provided with a shroud 30 to block off part of the outlet end 16 and to provide a discharge slot 31 in its lowermost end whereby to discharge the hot sand 23' into a continuous flow of granular material 11 being conveyed by a further auger constituted by a spiral wall 32 disposed intermediate the outer face 33 of the heating container side wall 12' and the inner surface 34 of an outer conical drum 35 which is concentrically secured about the heating container 12. The outer conical drum 35 is thus rotated with the inner container 12 and this rotation causes the granular material 11 to be displaced in the lower region of the outer drum 35 from an inlet end 36 to an outlet end 37, as is clearly shown in FIG. 3. As the granular material 11 and the heated sand 23' are conveyed in the direction of arrow 38, they are both mixed together and the sand dries or evaporates humidity trapped within the granular material 11.

The outer drum 35 has a dryer section 39 and a separator section 40. The dryer section is disposed in a portion of the drum inlet end 36 whereby to receive the heated sand at its maximum temperature and further to extract heat from the side wall 12' of the heating container 12 adjacent the heating chamber 27. The heat radiated by the side wall 12' also helps in drying the granular material 11.

The separator section 40 is disposed in a portion of the outer drum 35 adjacent the outlet end 37 and is provided with a particulate medium extractor element, herein a screen wall section 41, and a granular material conveyor, herein a screen wall chute 42. The screen wall section 41 has a sieve size which is smaller than the granular material being dried but large enough to permit the particulate medium to pass therethrough and to be collected in an annular cone-shaped collector drum 43 secured about the separator section 40 and rotated with the outer drum 35. The collector drum 43 has a peripheral annular trough 44 having a plurality of bucket sections 45 formed therein whereby to transport the sifted sand 28 back to the feeding device 22, as is well illustrated in FIG. 3. It is to be noted that because of the short residence time of the sand within the heating container 12 and also within the mixing and heat exchange outer drum 35, the sand is recycled back into the feeding device while still hot. The temperature of the sand when fed back to the feeding device 22 is about 100° C. While travelling through the heating chamber 27 the sand temperature is increased by approximately 100° to 200° C., thus leaving the outlet end at a desired temperature usually in the range of 200° to 300° C.

The feeding device 22 consists essentially of a funnel 46 having a lower chamber 47 in which is secured a feed auger 48 which is secured to the drive shaft 13. The lower chamber 47 extends within the inlet end 15 of the heating container 12. A drive motor 49 is coupled to the drive shaft 13, through a chain drive assembly 50, whereby to impart rotation to the drive shaft 13. It can be seen that a single drive motor 49 operates the entire apparatus and namely, drives the feed auger 48 to feed the particulate medium into the heating container 12, rotates the inlet auger 23 within the container and at the same time rotates the entire heating container 12 and outer drum 35 and the cone-shaped collector drum 43 and trough 44 which recirculates the particulate medium back into the heating container.

The humid granular material 11 is introduced into the inlet end 36 of the outer drum 35 by suitable means such as a chute (not shown) whereby to direct the granular material into a receiving chamber 51 which is defined by an annular outer flange wall 52 which is spaced outwardly of the shroud 30 at the outlet end of the heating container 12. The spiral wall 32 extends within this receiving chamber to convey the granular material past the discharge port 31 at the outlet end of the heating container 12.

It can be seen that the design of the drying apparatus 10 of the present invention, utilizing three frustums of cones rotating about a central axis 25, provides a novel and compact design and makes it possible to achieve minimum heat loss and to obtain efficient drying of a granular material by mixing with a heated particulate medium which is quickly recycled into a heating chamber where it is quickly heated to a desired temperature within a minimum residence time. To illustrate the compactness of this design the device as illustrated has a total length of 1.2 meters.

Some of the main features of the specific drying apparatus so constructed is its capacity to handle grain (corn) at a rate of 750 kg per per hour by raising its temperature from 5° C. to 75°–90° C. The machine operates at a continuous flow rate and the sand to grain mass ratio is easily controlled to suit desired applications. This control is achieved by controlling the grain feed rate, the amount of sand used and/or controlling the rpm of the apparatus. The heating process utilized by providing a heating chamber inside the heating container is very efficient and the residence time of the sand in the heating chamber is very short. Also, the apparatus has no separate internal moving parts and the whole machine is operated on the longitudinal central axis and driven by a single drive. Thus, there is provided a machine with enhanced heat transfer and quick heating of a granular material fed thereto in a continuous flow while occupying the minimum amount of space.

Some typical applications of the apparatus are for grain drying, grain processing for feeding, parboiling rice, roasting soy beans to get rid of trypsin and improve protein availability, processing ground nuts, processing oil seeds, controlling insect infestation in stored grains or heat treating any particulates. Breweries may also utilize the apparatus to process their yeast and a special type of particulate medium could be used to coat the grain in its moist state. The particulate medium may also consist of steel balls of selected size.

It is within the ambit of the present invention to cover any obvious modifications of the example of the preferred embodiment described herein, provided such modifications fall within the scope of the appended claims.

We claim:

1. A drying apparatus for drying granular material fed thereto in a continuous flow, said apparatus comprising a conical heating drum having an inlet end and an outlet end, heating means in said container, conveying means in said container adjacent said inlet end to displace a particulate medium capable of retaining heat from said inlet end to a heat chamber within said conical heating drum, shower means in said heat chamber for displacing said particulate medium for direct contact with a flame during a predetermined time so that said medium is quickly heated to an approximate desired temperature, a mixing and drying conical drum disposed entirely about said conical heating drum and having an inlet end and outlet end, auger means in said mixing and drying conical drum for conveying said heated particulate medium discharged from said outlet end of said heating drum with a humid granular material introduced at said inlet end of said mixing and drying conical drum, whereby to dry said material by heat transfer between said particulate medium and said granular material, said mixing and drying conical drum having a dryer section and a separator section, said dryer section being disposed in a portion of its inlet end, said separator section being disposed in a portion adjacent its outlet end and having a particulate medium extractor element and a granular material conveyor, an annular cone-shaped trough secured about said drum separator section and rotated therewith, whereby to recycle said particulate medium while still hot, means to recover said dried granular material and drive means drivingly coupled to impart rotation to all said conical drums and conveying means.

2. A heat drying apparatus as claimed in claim 1 wherein said conical heating drum is an open-ended frustum-shaped drum which progressively enlarges toward its outlet end, said heat chamber being located at said enlarged end.

3. A heat drying apparatus as claimed in claim 2 wherein said heating means is a gas burner supported internally of said heating drum adjacent its outlet end and disposed on the central longitudinal axis of said heating drum whereby to direct a flame toward its inlet end.

4. A heat drying apparatus as claimed in claim 3 wherein said particulate medium is sand, said sand being heated to a temperature in the range of between 200°–250° C., said granular material being grain.

5. A heat drying apparatus as claimed in claim 4 wherein the residence time of said sand from said inlet end to said outlet end of said conical heating drum is 15–20 seconds during which said sand temperature is elevated by approximately 100°–250° C., said sand being introduced at said inlet end of said heating drum at a temperature of about 100° C., said gas burner being a propane gas burner.

6. A heat drying apparatus as claimed in claim 2 wherein said conveying means comprises a short auger helix axially supported in said heating drum and having a helix of progressively increasing diameter with the peripheral edge thereof being closely spaced to an inner surface of said heating drum whereby to convey said particulate medium from said heating drum inlet end to said heat chamber and to obstruct said heating drum inlet end to prevent excess heat loss and said sand from blowing away through said heating drum inlet end.

7. A heat drying apparatus as claimed in claim 6 wherein said shower means is a plurality of scoop-like elements secured to said inner surface of said heating drum in said heat chamber for displacing said particulate medium from the bottom of said heating drum and projecting said medium in a shower-like manner in the path of said flame, said heated particulate medium being discharged by gravity through said enlarged outlet end of said heating drum.

8. A heat drying apparatus as claimed in claim 1 wherein said mixing and drying conical drum is concentrically supported about said heating drum and secured in spaced relation thereto by a spiral wall bridging said heating drum and mixing and drying conical drum and constituting said auger means.

9. A heat drying apparatus as claimed in claim 1 wherein said particulate medium extractor is a screen wall section of said mixing and drying conical drum disposed over said separator section and having a sieve size smaller than said granular material but sufficient to pass said particulate medium therethrough.

10. A heat drying apparatus as claimed in claim 9 wherein said trough has a plurality of transporting bucket-like cavities in a discharge end thereof for conveying sid heated particulate medium recovered from said screen wall section back to said inlet end of said heating drum.

11. A heat drying apparatus as claimed in claim 1 wherein there is further provided a feed funnel assembly at said inlet end of said heating container, said recovered heated particulate medium being released in said funnel assembly and conveyed into said inlet end of said conical heating drum by a feed auger.

12. A heat drying apparatus as claimed in claim 1 wherein said drive means is drivingly coupled to impart rotation to said feed auger, said conveying auger, and said auger means of said mixing and drying conical drum.

13. A heat drying apparatus as claimed in claim 1 wherein said inlet end of said mixing and drying conical drum is spaced from said outlet end of said conical heating drum, a discharge opening at said outlet end of said conical heating drum to release heated particulate medium in said mixing and drying conical drum, and an annular flange wall at said inlet end of said mixing and drying conical drum to define a granular material receiving chamber, said spiral wall extending into said chamber.

* * * * *